US006871639B2

(12) United States Patent
Seymour, II

(10) Patent No.: US 6,871,639 B2
(45) Date of Patent: Mar. 29, 2005

(54) WIRE GUIDE

(75) Inventor: Kenneth R. Seymour, II, Villa Park, IL (US)

(73) Assignee: International Engine Intellectual Property Company, LLC, Warrenville, IL (US)

( * ) Notice: Subject to any disclaimer, the term of this patent is extended or adjusted under 35 U.S.C. 154(b) by 52 days.

(21) Appl. No.: 10/453,268

(22) Filed: Jun. 3, 2003

(65) Prior Publication Data

US 2003/0205216 A1 Nov. 6, 2003

Related U.S. Application Data

(63) Continuation-in-part of application No. 09/713,154, filed on Nov. 14, 2000, now Pat. No. 6,584,949.

(60) Provisional application No. 60/165,821, filed on Nov. 16, 1999.

(51) Int. Cl.[7] ..... F02M 51/00

(52) U.S. Cl. ..... 123/476; 123/195 A; 123/195 E; 174/72 A

(58) Field of Search ..... 123/195 A, 195 E, 123/470, 476; 174/52.1, 72 A, 135

(56) References Cited

U.S. PATENT DOCUMENTS

| | | | | | |
|---|---|---|---|---|---|
| 5,129,834 | A | * | 7/1992 | Cranford | 439/130 |
| 5,211,149 | A | * | 5/1993 | DeGrace, Jr. | 123/470 |
| 5,597,980 | A | * | 1/1997 | Weber | 174/72 A |
| 5,598,824 | A | * | 2/1997 | Treusch et al. | 123/470 |
| 5,893,351 | A | * | 4/1999 | Akutagawa et al. | 123/470 |
| 6,590,162 | B1 | * | 7/2003 | Luedicke et al. | 174/135 |

* cited by examiner

*Primary Examiner*—Weilun Lo
(74) *Attorney, Agent, or Firm*—Susan L. Lukasik; Dennis Kelly Sullivan; Jeffrey P. Calfa

(57) ABSTRACT

A wire guide (101) is disposable on a device such as a fuel injector (103). The wire guide (101) includes a channel (215) having one or more intermittently spaced fingers (213) along an open side of the channel (215). The fingers (213) may allow wires (205, 207) to enter the channel (215) easily, but inhibit the ability of the wires (205, 207) to leave the channel (215) once they enter. The channel (215) comprises an inner wall (301) that at least partially follows an outer contour of a device such as a fuel injector (103). One or more retaining members (219, 221) are included with the wire guide (101), such that the wire guide (101) is securable to the device, such as a fuel injector (103).

23 Claims, 4 Drawing Sheets

100

WIRE GUIDE

This patent application is a continuation-in-part of and claims the benefit of the filing date of U.S. patent application Ser. No. 09/713,154 filed on Nov. 14, 2000, now U.S. Pat. No. 6,584,949, which application claims the benefit of Provisional U.S. patent application Ser. No. 60/165,821 filed on Nov. 16, 1999, all three applications having a common assignee and a common inventor, Kenneth R. Seymour II.

FIELD OF THE INVENTION

This invention relates to wire guides, including but not limited to wire guides for use under a valve cover of an internal combustion engine.

BACKGROUND OF THE INVENTION

Internal combustion engines, including diesel and gasoline engines, are known to have electronically-controlled fuel injectors. Such fuel injectors are controlled by electronic signals sourced by the engine's electronic control module. The electronic signals are transported via one or more wires to the fuel injectors, which are often disposed under the valve cover of the engine.

Also under the valve cover are moving parts, such as rocker arms. The fuel injector wires need to be guided to the fuel injectors without being damaged by the moving parts, without interfering with moving parts, and without becoming entangled with the moving parts.

Accordingly, there is a need for guiding wires under the valve cover of an engine such that the wires are not damaged by, do not interfere with, and do not becoming entangled with moving parts.

SUMMARY OF THE INVENTION

A wire guide for use in an engine comprises a channel having an open side with one or more intermittently spaced retaining fingers, wherein the channel comprises an inner wall that has a shape that mates at least partially with an outer contour of a fuel injector. One or more retaining members are operably connected to the channel and are configured such that the wire guide is securable to a fuel injector. At least one wire disposed at least partially in the wire guide is guidable and protectable from moving parts underneath a valve cover in the engine.

DESCRIPTION OF A PREFERRED EMBODIMENT

The following describes an apparatus for and method of guiding wires, for example, under the valve cover of an engine while avoiding entanglement of the wires with moving parts under the valve cover, while avoiding damage to the wires by the moving parts, and while preventing interference by the wires with the moving parts. The wire guide is disposable on a device such as a fuel injector. The wire guide includes a channel having one or more intermittently spaced fingers along an open side of the channel, which fingers allow the wires to enter the channel easily but inhibits the ability of the wires to leave the channel once they enter. The channel comprises an inner wail that at least partially follows an outer contour of a fuel injector. One or more retaining members are included with the wire guide, such that the wire guide is securable to the fuel injector. This application is related to U.S. patent application Ser. No. 09/713,154, filed Nov. 14, 2000, and issued on Jul. 1, 2003 as U.S. Pat. No. 6,584,949, the entire contents of which application are hereby incorporated by reference.

Figure 1:
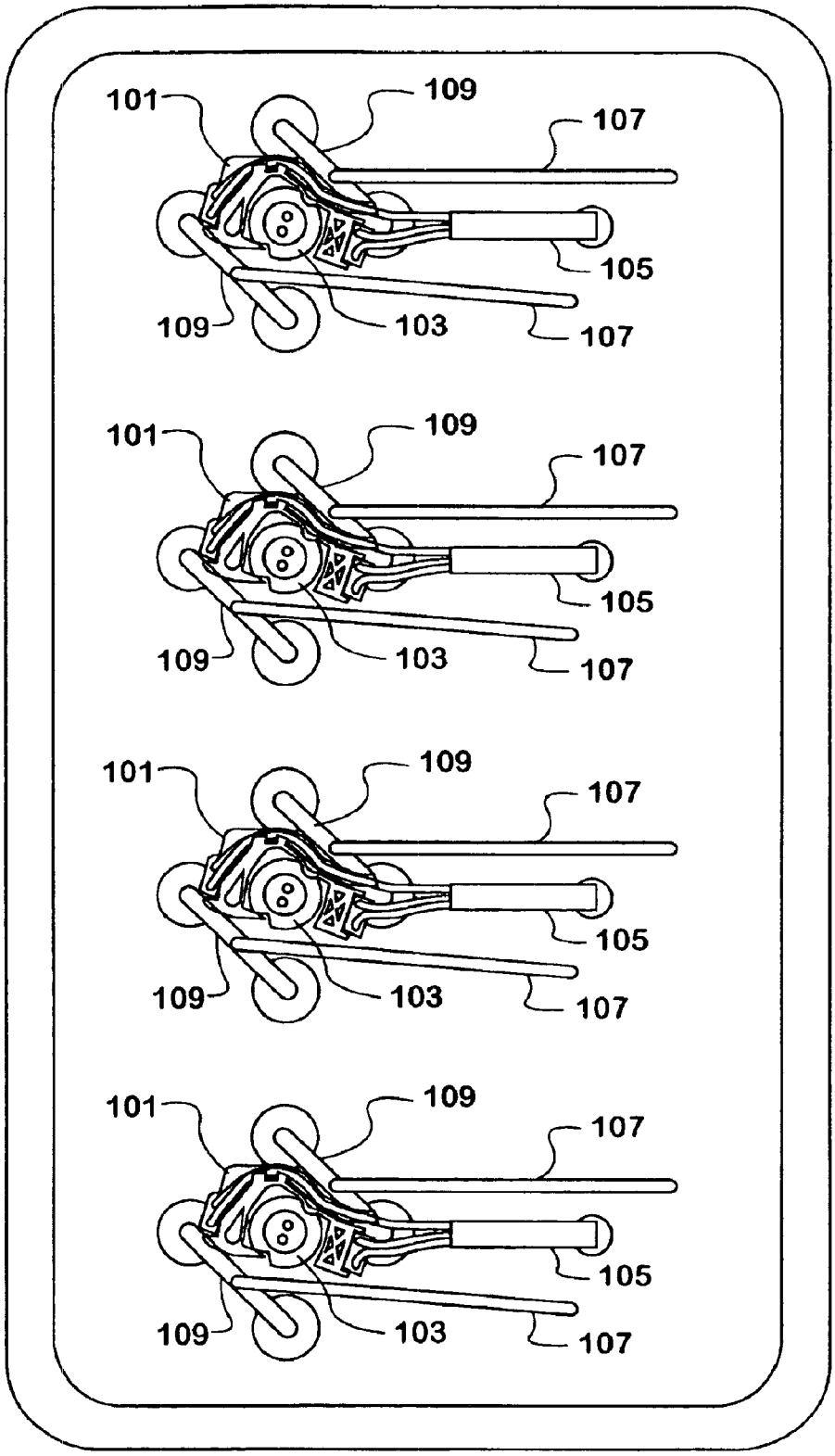
FIG. 1 is a top view of a plurality of wire guides disposed with respect to a cylinder head in accordance with the invention.

A top view of a plurality of wire guides disposed with respect to a cylinder head 100 of an internal combustion engine is shown in FIG. 1. A plurality of wire guides 101 are shown disposed on a plurality of fuel injectors 103. As shown in FIG. 1, the wire guides 101 are disposed on the control valve body of the fuel injector 103, although the wire guide need not necessarily be disposed on the control valve body. Wires (see wires 201, 203, 205, and 207 of FIG. 2) for each fuel injector 103 are advantageously provided to location near the fuel injector 103. The wires 201, 203, 205, and 207 are bundled in a bundling device 105, e.g., a sheath, heat shrink, cable ties, and so forth, such that the wires 201, 203, 205, and 207 remain bundled until they are very close to the fuel injector 103, thereby protecting them from movable parts, such as the rocker arms 107 or valve assemblies 109 attached to the rocker arms 107. The wire guide 101 is disposed at a distance from the valve assemblies such that when the valve assemblies 109 are closest to the wire guide 101, the valve assemblies 109 do not touch the wire guide 101. The view shown in FIG. 1 is of the cylinder head with the valve cover (not shown) removed. The items shown in FIG. 1 are under the valve cover.

Figure 2:
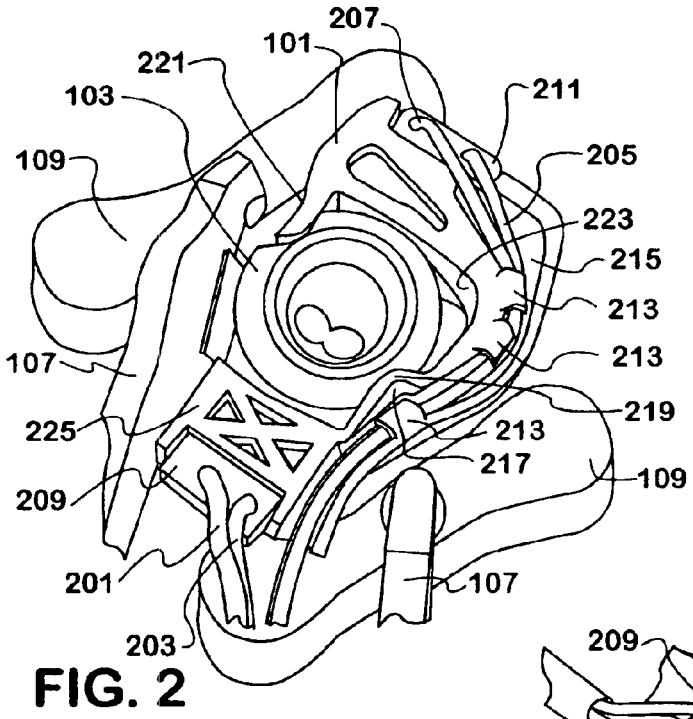
FIG. 2, FIG. 3, and FIG. 4 are top views of a wire guide disposed with respect to a cylinder head in accordance with the invention.
Figure 3:
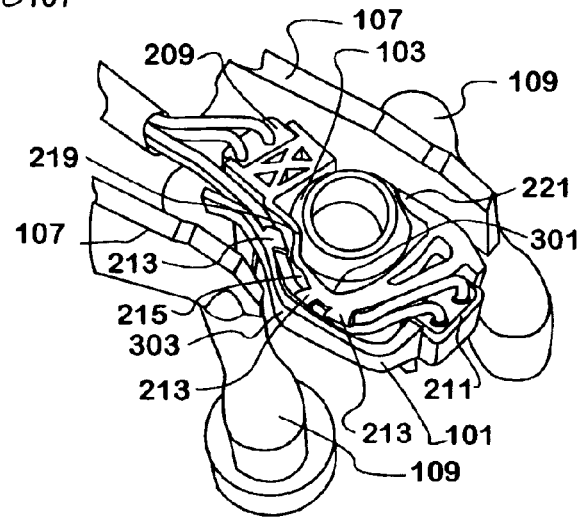
Figure 4:
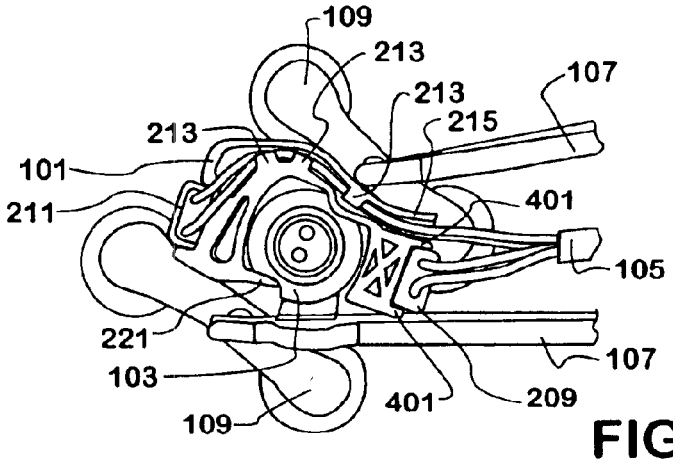

Top views of a wire guide 101 disposed with respect to a cylinder head 100 are shown in FIG. 2, FIG. 3, and FIG. 4. A plurality of wires 201, 203, 205, and 207 are connected to electrical overmolds 209 and 211 disposed on the fuel injector 103. In the embodiment show, two wires 201 and 203 are connected to one electrical overmold 209 while the two other wires 205 and 207 are connected to the other electrical overmold 211. Two wires 205 and 207 are trapped by one or more intermittently spaced retaining fingers 213 along an open side of a channel 215. The retaining fingers 213 will be described in more detail with respect to FIG. 8.

The channel 215 comprises an inner wall 301 that at least partially follows an outer contour of the device on which the wire guide 101 is mounted, such as a fuel injector 103, i.e., the inner wall at least partially has a mating shape of the outer contour of the device on which the wire guide 101 is mounted, e.g., a fuel injector 103. The inner wall 301 at least partially follows the outer contour of the device when its shape mates with the shape of the outer contour in one or more continuous or non-continuous points on the outer contour of the device. For example, as shown in FIG. 2, and moving in a clockwise direction around the inner surface of the wire guide 101, the retaining member 221 mates with a part of a slot in the fuel injector 103, the inner wall 301 then ceases to follow the contour until it again touches the contour at a mating point 223, after which it again ceases to mate with the outer contour until retaining member 219, which follows the shape of the slot in the fuel injector, after which the inner wall 301 again ceases to mate with the outer contour of the fuel injector 103, and after the base 225 extends from the inner wall 301, at least a part of the base 225 mates for at least a point with the outer contour of the fuel injector 103. Alternatively, the inner wall 301 may completely follow the outer contour of the fuel injector, i.e., the inner wall 301 may be shaped to mate closely with the shape of the entire outer contour of the fuel injector 103. Thus, the wire guide 101 may partially surround the outer contour of the fuel injector 103, or the wire guide 101 may completely surround the outer contour of the fuel injector 103. The inner wall 301 mates the outer contour of the fuel injector 103 in a sufficient number of places that the wire guide 101 does not rotate about the fuel injector 103 in such a way as to interfere with any moving parts or cause the wires 201, 203, 205, and/or 207 to become entangled with or damaged by the moving parts.

The fuel injector 103 shown in the drawings includes two slots or counter bores that are formed in the top of the fuel injector 103 along the outer contour to allow fasteners, such as screws, to be inserted into the fuel injector 103. The wire guide 101 includes one or more retaining members 219 and 221 that are capable of being inserted in the slots disposed along the outer contour of the fuel injector 103. The shape of the retaining members 219 and 221 may match the shape of the slots, but such matching is not necessary. The retaining members 219 and 221 may be inserted entirely within the slots or partially within the slots. One retaining member 219 may be part of or attached to the inner wall 301 of the channel 215. The other retaining member 221 may be a flexible member disposed near one end of the channel 215 and flexing to fit partially within the slot of the fuel injector 103. When the wire guide 101 completely surrounds the channel 215, the retaining members 219 may be part of or attached to the inner wall of the wire guide that surrounds the outer contour of the fuel injector 103.

The wire guide 101 advantageously includes a base 225 that is disposed between the electrical overmold 209 and the fuel injector 103. The base 225 may touch the fuel injector 103, and may at least partially follow its outer contour. The base 225 may include one or more extensions 401 that engage the outer edges of the electrical overmold 209, such that the wire guide 101 is inhibited from rotating about the fuel injector 103.

Figure 5:
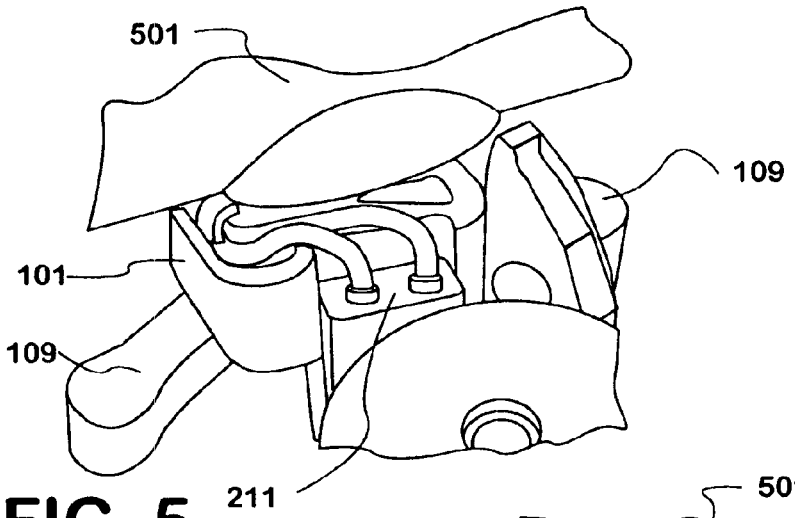
FIG. 5 and FIG. 6 show a wire guide disposed with respect to a fluid rail in accordance with the invention.
Figure 6:
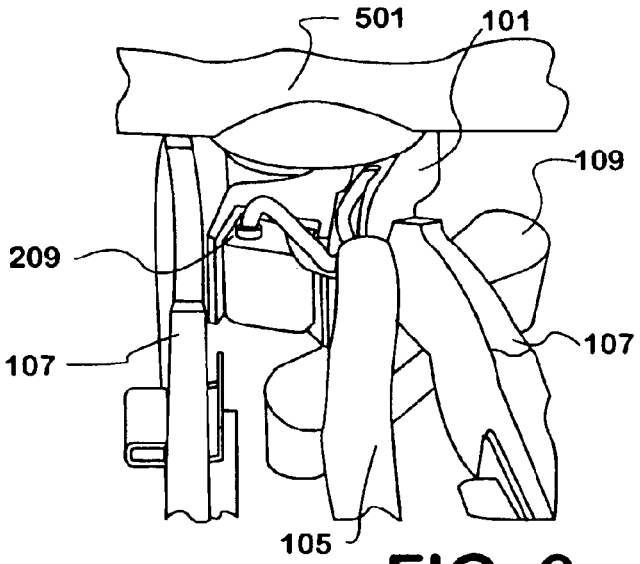

Views of a wire guide disposed with respect to a fluid rail 501 are shown in FIG. 5 and FIG. 6. The fluid rail 501, which may contain fuel, oil, or another fluid(s), may be disposed on the top of the fuel injectors 103. The wire guides 101 are advantageously disposed below any fluid rail such that the wires 201, 203, 205, and/or 207 are not damaged.

Figure 7:
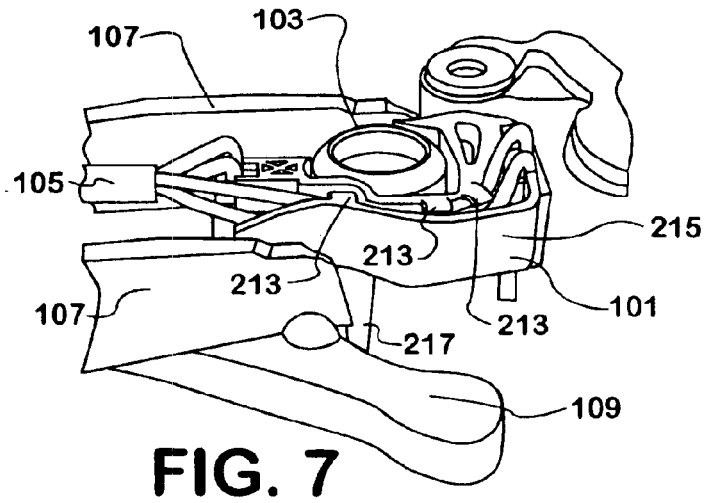
FIG. 7 is a side view of a wire guide disposed with respect to a cylinder head in accordance with the invention.

A side view of a wire guide disposed with respect to a cylinder head is shown in FIG. 7. A support member 217 may optionally be disposed below the channel 215 such that the wire guide 101 is prevented from sliding down the outer contour of the fuel injector, e.g., toward the cylinder head 100. The support member 217 may be attached to the retaining member 219, may reside in the same slot of the fuel injector 103 as the retaining member 219, and the distal end of the support member may rest on one of the fasteners on the fuel injector.

Figure 8:
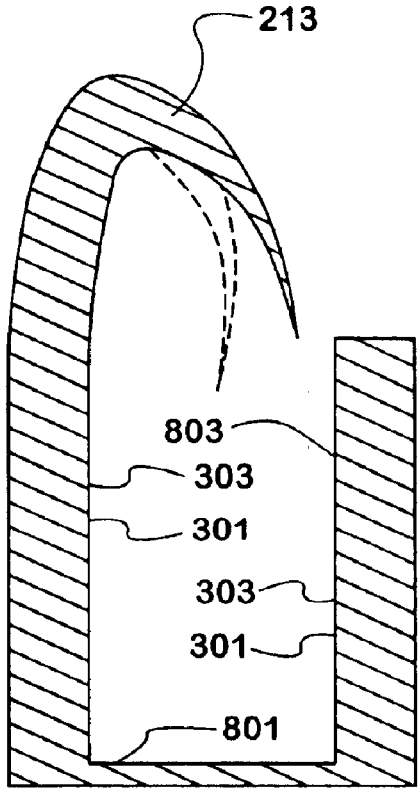
FIG. 8 and FIG. 9 are cross-sectional views of a channel of a wire guide taken through one or more retaining fingers in accordance with the invention.

A cross-sectional view of a channel of a wire guide taken through a retaining finger 213 is shown in FIG. 8. A retaining finger 213 is shown disposed on either the inner wall 301 or the outer wall 303 of the channel 215. A lower support 801 is disposed between the inner wall 301 and the outer wall 303. The end or point of the retaining finger 213 is advantageously disposed near the end of the opposing wall 803. Although three retaining fingers 103 are shown in the drawings, one or more retaining fingers 213 may be successfully utilized.

The retaining fingers 213 are advantageously flexible and shaped somewhat like a hook. The retaining fingers 213 are advantageously capable of flexing to allow a wire 205 or 207 to enter the channel 215, which position is shown by the dotted lines, and the retaining fingers 213 then return to their normal shape. Further, the retaining fingers 213 are advantageously capable of trapping one or more wires 205 and 207 in the channel 215 thereby resisting removal of the wire, because the distance between the end of the retaining finger 213 and its opposing wall 803 is advantageously smaller than the diameter of a wire 205 or 207, and once a wire 205 or 207 enters the channel 215, it pushes against the pointed end of the retaining fingers 213, thereby pushing the point closer to the opposing wall 803, decreasing the space between the point of the retaining fingers 213, thus resisting removal of the wires 205 and 207.

Other forms of retaining fingers 213 may also be successful. For example, the retaining fingers 213 may be simple tabs or nubs that extend from one wall 301 or 303 in a direction toward the other wall 303 or 301. Such tabs or nubs need not be flexible. At least a part of the channel 215, such as the outer wall 303, is capable of flexing to allow a wire to enter the channel 215. Such an embodiment may include an outer wall 303 that is not a solid wall but rather comprises a plurality of intermittent supports. One or more of the intermittent supports may have a retaining finger 213 disposed at one end. Alternatively, a retaining finger 213 may be disposed on the opposite wall 803, at or near an edge of the opposite wall 803.

Figure 9:
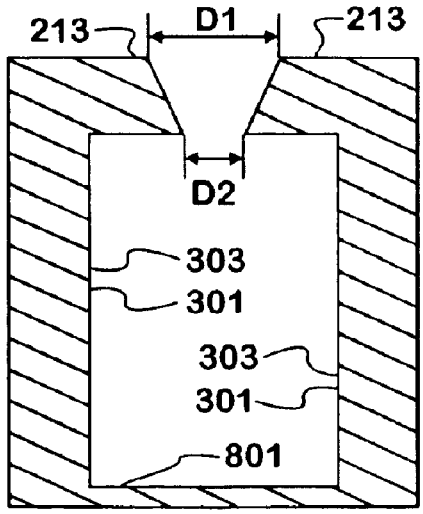

Alternatively, the retaining fingers 213 may comprise a tapered face, an upper edge that forms an outer edge of the channel, and a lower edge that borders a conduit of the channel 215, such as provided in U.S. Pat. No. 6,584,949 and shown in FIG. 9. The retaining fingers 213 may be formed as one or more finger pairs along the open side of the channel 215, wherein each finger pair includes a first distance D1 between the upper edges of the finger pair and a second distance D2 between the lower edges of the finger pair; wherein the first distance is larger than the second distance, and wherein the finger pair results in an inverted wedge-shaped opening between the finger pair. The retaining fingers 213 may be disposed in any combination on the inner wall 301 of the channel and on the outer wall 303 of the channel. The fingers 213 may all be disposed on one wall or the other, or disposed on both walls 301 and 303. The retaining fingers 213 may be formed as a series of alternating opposing tabs along the open side of the channel. Such finger embodiments are shown and described in U.S. patent application Ser. No. 09/713,154, issued on Jul. 1, 2003 as U.S. Pat. No. 6,584,949.

The wire guide 101 is advantageously made of plastic and/or other appropriate materials as known in the art. The wire guide 101 may be molded from a single material, such as a plastic that has memory, such that the retaining fingers 213 move back to their original shape/position once a wire 205 or 207 pushes past them, or the wire guide 101 may be made of a two or more materials. When the wire guide 101 is utilized in an environment that may provide additional hazards, appropriate materials should be utilized. For example, when the wire guide 101 is disposed under a valve cover, the wire guide 101 should be able to withstand heat and be able to survive in oil. One or more wires may be guided through the channel 215 of the wire guide 101.

Although the wire guide is described in the drawings as being disposed on a fuel injector under a valve cover, the wire guide may be utilized in other applications or with other devices, and the wire guide need not be disposed on a fuel injector and need not be under a valve cover.

The wire guide of the present invention protects and guides one or more wires from moving parts, for example, under a valve cover of an engine, while directing the wires to their desired location in a secure manner. The wires are securely retained in the channel of the wire guide, such that they do not interfere with moving parts, do not become entangled with moving parts, and are not damaged by the moving parts during engine operation. The channel that guides and protects the wires is also partially utilized to mount the wire guide in position. The wire guide may distribute the loading of the wires as a strain relief, for example, when picked up or carried by the wires.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

What is claimed is:

1. A wire guide for use in an engine, the wire guide comprising:

a channel having an open side with one or more intermittently spaced retaining fingers, wherein the channel comprises an inner wall that has a shape that mates at least partially with an outer contour of a fuel injector;

one or more retaining members operably connected to the channel, the one or more retaining members configured such that the wire guide is securable to a fuel injector;

wherein at least one wire disposed at least partially in the wire guide is guidable and protectable from moving parts underneath a valve cover in the engine.

2. The wire guide of claim 1, wherein at least one of the retaining fingers is comprised of a flexible material that is narrower near one end.

3. The wire guide of claim 1, wherein the one or more retaining members are capable of being inserted in at least one slot disposed along the outer contour of the fuel injector.

4. The wire guide of claim 1, wherein at least one of the one or more retaining members is a flexible member disposed near an end of the channel.

5. The wire guide of claim 1, wherein at least one of the one or more retaining members is disposed on the inner wall of the channel.

6. The wire guide of claim 1, further comprising a base disposed near an end of the channel, wherein the base is disposable between an electrical overmold of a fuel injector and the fuel injector.

7. The wire guide of claim 1, further comprising a base disposed near an end of the channel, wherein the base includes one or more extensions that are engagable with one or more edges of an electrical overmold of the fuel injector, such that the wire guide is inhibited from rotating about the fuel injector.

8. The wire guide of claim 1, further comprising a support member disposed below the channel such that the wire guide is prevented from sliding down the outer contour of the fuel injector.

9. The wire guide of claim 1, wherein the wire guide at least partially surrounds the outer contour of the fuel injector.

10. The wire guide of claim 1, wherein at least one of the one or more intermittently spaced retaining fingers comprises a flexible finger disposed along the open side of the channel such that the flexible finger is capable of flexing to allow a wire to enter the channel.

11. The wire guide of claim 1, wherein at least one of the one or more intermittently spaced retaining fingers comprises a flexible finger disposed along the open side of the channel such that when at least one wire is disposed in the channel, the flexible finger resists allowing the at least one wire to leave the channel.

12. The wire guide of claim 1, wherein at least one of the one or more intermittently spaced retaining fingers is disposed on the inner wall of the channel, and wherein at least one of the one or more intermittently spaced retaining fingers is disposed on an outer wall of the channel.

13. The wire guide of claim 1, wherein the channel is further comprised of an outer wall that is at least partially solid.

14. The wire guide of claim 13, wherein the outer wall is comprised of one or more intermittent supports, wherein at least one of the retaining fingers is disposed at one of (a) an end of one of the one or more intermittent supports and (b) an edge of the inner wall.

15. The wire guide of claim 1, wherein the retaining fingers comprise:

a tapered face;

an upper edge that forms an outer edge of the channel; and a lower edge that borders a conduit.

16. The wire guide of claim 1, wherein the retaining fingers are formed as one or more finger pairs along the open side of the channel, wherein each finger pair includes:

a first distance between the upper edges of the finger pair;

a second distance between the lower edges of the finger pair, wherein the first distance is larger than the second distance and wherein the finger pair results in an inverted wedge-shaped opening between the finger pair.

17. A wire guide for use in an engine, the wire guide comprising:

a channel having an open side with one or more intermittently spaced retaining fingers, wherein the channel comprises an inner wall that has a shape that mates at least partially with an outer contour of a fuel injector, and wherein at least a part of the channel is capable of flexing to allow a wire to enter the channel;

one or more retaining members operably connected to the channel, the one or more retaining members configured such that the wire guide is securable to a fuel injector;

wherein at least one wire disposed at least partially in the wire guide is guidable and protectable from moving parts underneath a valve cover in the engine.

18. The wire guide of claim 17, wherein, when at least one wire is disposed in the channel, the one or more intermittently spaced retaining fingers resist allowing the at least one wire to leave the channel.

19. The wire guide of claim 17, wherein the one or more intermittently spaced retaining fingers are capable of flexing to allow a wire to enter the channel.

20. The wire guide of claim 17, wherein the one or more intermittently spaced retaining fingers are formed as a series of alternating opposing tabs along the open side of the channel.

21. A wire guide for use in an engine, the wire guide comprising:

a channel having an open side with one or more intermittently spaced retaining fingers, wherein the channel comprises an inner wall that has a shape that mates at least partially with an outer contour of a fuel injector;

one or more retaining members operably connected to the channel, the one or more retaining members configured such that the wire guide is securable to the fuel injector by the one or more retaining members and at least a part of the inner wall of the channel;

wherein at least one wire disposed at least partially guided in the wire guide.

22. The wire guide of claim 21, wherein at least one of the one or more intermittently spaced retaining fingers comprises a flexible finger disposed along the open side of the channel such that the flexible finger is capable of flexing to allow a wire to enter the channel.

23. The wire guide of claim 21, wherein at least one of the one or more intermittently spaced retaining fingers comprises a flexible finger disposed along the open side of the channel such that when at least one wire is disposed in the channel, the flexible finger resists allowing the at least one wire to leave the channel.

* * * * *